US005430231A

United States Patent [19]

Wlassics et al.

[11] Patent Number: 5,430,231

[45] Date of Patent: Jul. 4, 1995

[54] PROCESS FOR THE DISPOSAL OF CHLORINATED ORGANIC PRODUCTS BY SULPHONATION OR NITRATION AND SUBSEQUENT OXIDATION

[75] Inventors: Ivan Wlassics, Genova; Fulvio Burzio; Mario Alfieri, both of Milan, all of Italy

[73] Assignee: Ausimont S.p.A., Italy

[21] Appl. No.: 154,307

[22] Filed: Nov. 18, 1993

[30] Foreign Application Priority Data

Nov. 20, 1992 [IT] Italy ..... MI92A2656
Jun. 16, 1993 [IT] Italy ..... MI93A1288

[51] Int. Cl.[6] ..... A62D 3/00

[52] U.S. Cl. ..... 588/206; 208/262.5; 588/207

[58] Field of Search ..... 208/262.5; 588/205, 588/206, 207, 216, 220, 226, 228, 231

[56] References Cited

U.S. PATENT DOCUMENTS 5,118,429 6/1992 Anderson et al. ..... 210/758

5,290,432 3/1994 Friedman et al. ..... 208/262.5

OTHER PUBLICATIONS

European Search Report Dated Jan. 25, 1994.
Derwent Abstract of JP-A-3 101 893 26 Apr. 91.
Derwent Abstract of JP-A-53 099 657 31 Aug. 78.

*Primary Examiner*—Gary P. Straub
*Attorney, Agent, or Firm*—Bryan Cave

[57] ABSTRACT

A process for the disposal of chlorinated organic products, wherein said products are first treated with a sulphonating or nitrating agent, and then are oxidized with an aqueous solution of $H_2O_2$, in the presence of Fe(II) ions as catalysts, optionally in association with ions of other transition metals selected from Cu(II), Ti(IV), Mn(II), Co(II), Ni(II), W(IV), Mo(IV), or mixtures thereof. The process leads to a substantially complete elimination of the chlorinated organic products with consequent, considerable reduction of the Chemical Oxygen Demand (COD), and to a high mineralization degree of the organic chlorine atoms.

20 Claims, No Drawings

PROCESS FOR THE DISPOSAL OF CHLORINATED ORGANIC PRODUCTS BY SULPHONATION OR NITRATION AND SUBSEQUENT OXIDATION

The present invention relates to a process for the disposal of chlorinated organic products, which comprises a treatment based on sulphonation or nitration and subsequent oxidation with $H_2O_2$.

The chlorinated organic products are a class of substances widely used in various technological fields. Among them, the compounds having alkyl, aromatic, or alkylaromatic structure, such as polychlorobiphenyls (PCBs), 1,1,1-trichloro-2,2-bis(p-chlorophenyl)ethane (DDT) , tetrachloroethane, dichlorobenzenes, chlorophenols, hexachlorocyclohexane, or olefinic structure, such as trichloroethylene, are the more common.

Generally, they are toxic and highly polluting products, whose disposal after use involves many problems. In fact, it is necessary to utilize a disposal process, applicable also on a large scale, which is as much as possible efficacious, economical and free from risks for the environment. It is particularly difficult to reach said optimum objective, since the chlorinated organic products have a high stability and, when treated with chemical and/or physical means, form highly polluting by-products.

For instance, polychlorobiphenyls (PCBs) are highly toxic and cancerogenous chloroaromatic compounds, which were broadly utilized since short ago, thanks to their dielectric properties, as oils for electrical equipment, and in particular for capacitors. Owing to their high toxicity, the regulations in force impose the PCBs elimination and their substitution with hydrocarbon mineral oils. That makes necessary to remove great amounts of PCBs, which usually are either dissolved in organic solvents (for example hexachlorobenzene), or impregnated in isolating and/or supporting materials, such as paper, paper-board, wood, etc. Furthermore, it is often necessary to remove the PCBs from mineral oils, which could be contaminated in consequence of a not correct cleaning of the electrical equipment before the replacement.

The most commonly utilized treatment for the disposal of chlorinated organic products is burning, which is carried out in properly equipped plants in order to prevent the formation of utmost toxic chloro-organic compounds, such as parachlorodibenzodioxines, parachlorodibenzofurans and the like. In any event, this is an expensive process, not free from risks for the environment, apart from the fact that it involves the elimination not only of the chlorinated compounds, but also of the materials polluted by them.

The Applicant has now found a process for the disposal of chlorinated organic products via sulphonation or nitration followed by oxidation with $HO_2$, $O_2$, which permits to obtain a substantially complete elimination of the chlorinated organic products, with consequent reduction of the Chemical Oxygen Demand (COD) to values lower than 300 mg/l, and a high mineralization degree of the chlorine atoms, i.e. conversion of the organic chlorine into chlorine ions.

Thus, object of the present invention is a process for the disposal of chlorinated organic products, which comprises:

(a) treating said products with a sulphonating or nitrating agent;

(b) oxidizing the sulphonation or nitration products obtained from step (a) with a $H_2O_2$ aqueous solution, in the presence of Fe(II) ions, optionally in association with ions of one or more transition metals selected from Cu(II), Ti(IV), Mn(II), Co(II), Ni(II), W(IV), and Mo(IV).

Among the chlorinated products to which the process of the present invention can be applied we mention those having:

(a) an aromatic structure, such as polychlorobiphenyls, chlorobenzenes (for instance, ortho- and methadichlorobenzene), chlorophenols (for instance para-, tri-and penta-chlorophenol), etc.;

(b) an alkylaromatic structure, such as 1,1,1-trichloro-2,2-bis(p-chlorophenyl)ethane (DDT), and others;

(c) an olefinic structure, such as trichloroethylene, perchlorobutadiene, etc.;

(d) an aliphatic or cycloaliphatic structure, such as tetrachloroethane, hexachlorocyclohexane, hydrated chloral, hexachloroethane, perchloroacetone, etc.

The sulphonation reaction of step (a) is conducted with a proper sulphonating agent, such as $H_2SO_4$, or, preferably, oleum (mixture of $H_2SO_4$ and $SO_3$). Sulphuric acid can be utilized also in the form of a concentrated aqueous solution, at concentrations ranging from 70 to 99% by weight. The reaction is conducted at a temperature generally ranging from 20° to 80° C., preferably from 20° to 40° C., while the molar ratio sulphonating agent/chlorinated organic product generally ranges from 0.5:1 to 10:1. The reaction times can vary over a wide range, depending on both the temperature and the concentration of the sulphonating agent, and generally range from about 1 minute to 15 minutes.

As an alternative to sulphonation, the nitration reaction is conducted with a proper nitrating agent, in an acid medium due to the addition of a strong mineral acid. As a nitrating agent $HNO_3$ can be used, in the form, for example, of a concentrated aqueous solution, with concentrations ranging from 50 to 99% by weight. Particularly profitable both from an economic viewpoint and for the easy availability is the so-called fuming nitric acid, i.e. a concentrated $HNO_3$ solution (usually at 90% by weight), in which $NO_2$ is dissolved. The strong mineral acid, which acts as a catalyst, can be selected from: $H_2SO_4$, $H_3PO_4$, HCl etc. Preferably a concentrated aqueous solution of $H_2SO_4$ (at 70–99% by weight) is used. The molar ratio of strong mineral acid to $HNO_3$ can be varied over a wide range, generally from 0.5 to 5.0. A mixture composed of fuming $HNO_3$ (at 90% by weight) and of concentrated $H_2SO_4$ (at 96% by weight) is advantageously utilizable in the process of the present invention.

The nitration reaction is conducted at a temperature generally ranging from 70° to 200° C., preferably from 90° to 160° C. The nitrating agent is utilized at least in an equimolar amount with respect to the chlorinated organic product to be disposed, although an excess of nitrating agent should be preferably utilized in order to obtain the most possible complete nitration. The molar ratio of nitrating agent to chlorinated organic product is therefore generally comprised between 1:1 and 500:1, preferably between 50:1 and 400:1. The reaction times can vary over wide ranges, as a function of temperature and concentration of the nitrating agent, and generally they are comprised between about 1 minute and 20 minutes.

The sulphonation or nitration reaction of step (a) has probably the effect of weakening the carbon-chlorine bonds through introduction of electron-donor groups, so as to render the structure of the chlorinated organic porduct more easily oxidable.

From an operative viewpoint and for a large-scale application of the process, the sulphonation reaction is to be considered as preferable in comparison with nitration, since sulphates, other than nitrates, are more easily removable from the process water by precipitation of insoluble salts, for example by addition of $Ca(OH)_2$ and consequent precipitation of calcium sulphate.

Prior to proceed to oxidation step (b), the stability of the molecules of the chlorinated organic product sulphonated or nitrated can be further weakened by treatment with a proper aminating agent (step (a')), which probably operates a nucleophilic substitution on the chlorine atoms. As an aminating agent, for example, a concentrated aqueous solution of $NH_3$ (at 20–30%) can be used. On the basis of the tests conducted by the Applicant, it results that the treatment with an aminating agent, although not essential for the obtainment of a satisfactory final result, can be useful in those cases in which a complete mineralization of the organic chlorine is to be obtained also when in oxidation step (b) a diluted $H_2O_2$ solution, for example at a concentration below 15% by volume, is utilized. In fact, it has been found that the amination reaction already leads to a partial mineralization of the organic chlorine.

If also step (a') is to be carried out, the sulphonated or nitrated products, obtained from step (a) at a strongly acid pH, shall be preliminarily neutralized with a strong base, in order to bring the pH to a value ranging from 5 to 9. The amination reaction is generally conducted at 80°–100° C., for times of from 0.5 to 6 hours, with an aminating agent/chlorinated organic product molar ratio comprised between 1:5 and 1: 15.

The oxidation reaction (step (b)) is carried out using $H_2O_2$ as an oxidant and Fe(II) ions as catalysts, optionally associated with ions of one or more transition metals selected from Cu(II), Ti(IV), Mn(II), Co(II), Ni(II), W(IV) and Mo(IV). The Cu(II) ions are preferred. The metal ions are added in amounts generally ranging from 50 to 500 ppm for the Fe(II) ions and from 0 to 400 ppm for the other transition metal ions listed hereinbefore. In a preferred embodiment, the Fe(II) ions are associated with the Cu(II), Ti(IV), Mn(II), Co(II), Ni(II), W(IV) or Mo(IV) ions, in equimolar amounts, each in concentrations ranging from 50 to 400 ppm, preferably from 100 to 250 ppm.

The abovesaid metal ions are added in the form of soluble salts. As regards in particular the Fe(II) ions, it is possible to use, for example, ferrous sulphate, ferrous chloride, ferrous nitrate, ammonium ferrous sulphate, etc. Heptahydrated ferrous sulphate $FeSO_4.7H_2O$ is preferred from an economic and operative viewpoint. Among the Cu(II) soluble salts, for example, pentahydrated cupric sulphate $CuSO_4.5H_2O$ is employable.

As regards hydrogen peroxide, it is utilized in the form of an aqueous solution, in amounts ranging from 1 to 40 stoichiometric equivalents, preferably from 1 to 10 stoichiometric equivalents. By stoichiometric equivalent it is meant the theoretical amount of $H_2O_2$ (at 100%) which is required for a complete oxidation to $CO_2$ and $H_2O$ of the chlorinated organic compounds. The concentration of the hydrogen peroxide aqueous solution is not a discriminating parameter; for reasons of operative simplicity, $H_2O_2$ solutions at 30–70% by volume are generally utilized. The hydrogen peroxide solution is preferably added gradually and continuously to the reaction mixture in order to more easily control the reaction conditions, in particular the pH. The addition rate usually ranges from 0.1 to 2 ml/min., but it can be varied over a wider range, depending on the reaction conditions.

If the chlorinated organic product is dissolved in an organic non-hydrophilic medium, before effecting the oxidation, which is conducted in the aqueous phase, it is advisable to separate the sulphonation or nitration products from the organic medium, so as to promote the contact between said products and the oxidant ($H_2O_2$). The separation of the sulphonated or nitrated products can be carried out by means of conventional techniques, for example by extraction with water, or by precipitation.

The temperature at which the oxidation reaction is conducted can vary over a wide range, generally from 20° to 100° C., preferably from 40° to 90° C. The pH generally ranges from 1 to 7, preferably from 3 to 4, approximately, and during the reaction it is maintained in such ranges by little additions of an aqueous solution of an acid (for example $H_2SO_4$) or of a base (for example NaOH).

The present invention will be now described in detail by the following examples, which are given merely to illustrate and not to limit the scope of the invention.

In each example, the effect of each step of the process has been evaluated by drawing a 5 ml sample of the reaction mixture and determining the following parameters:

(a) Concentration of the chlorinated organic product

It was determined by means of gas chromatographic analysis, with a SE-54 capillary column (stationary column: 5% phenyl silicone, 95% methyl silicone) having a length of 25 m. For samples obtained further to treatment of polychlorobiphenyls (PCBs) in mineral oil, an electron capture detector was utilized (carrying gas: helium; make-up gas: nitrogen; temperature program: isotherm at 100° C. for 40 seconds, gradient at 30° C./min. up to 160° C., gradient at 5° C./min. up to 200° C., isotherm at 200° C. for 35 minutes; standing current: 0.41 nA; splint opening: 40 seconds after injection; injected sample: 1 μl, diluted 400 times with octane).

For the other samples, obtained further to the treatement of pure chlorinated organic products, a flame detector was utilized (the conditions were identical with the ones indicated above for the electron capture detector), injecting 0.6 μl samples, diluted with $CH_2Cl_2$ in a 1:2 ratio.

As regards PCBs, all the calculations were referred to the four main PCBs isomers, for which the following composition was determined:

| | |
|---|---|
| 1.44% | $C_{12}H_7Cl_3$ (referred to as Cl-3) |
| 67% | $C_{12}H_6Cl_4$ (referred to as Cl-4) |
| 19.65% | $C_{12}H_5Cl_5$ (referred to as Cl-5) |
| 11.91% | $C_{12}H_4Cl_6$ (referred to as Cl-6). |

(b) Chlorine ion concentration

The chlorine ions are recovered by means of extraction with $H_2O$ acidified with 0.1% of $HNO_3$ and are analyzed through voltimetric titration in an acid medium with $AgNO_2$.

(c) COD (Chemical Oxygen Demand)

It was determined through oxidation with bichromate in an acid medium and titration with ferrous sulphate, according to the method described by N. W. Hanson in "Official, Standardized and Recommended Methods of Analysis" (page 383, The Society for Analytical Chemistry, 1973).

(d) $BOD_5$ (Biological Oxygen Demand).

It was determined according to the method described in "Standard AOAC Methods 1980" (page 548, section 33.019).

EXAMPLE 1

Sulphonation of pure PCBs 3.2 ml of oleum ($H_2SO_4+SO_3$) were introduced into a 40 ml two-neck flask, equipped with dropping funnel, thermometer and magnetic stirrer, 1.25 ml (1.64 g) of pure PCBs (commercial product Aroclor® 1242were then dropped thereinto, at a flowrate equal to about 0.125 ml/min. The molar ratio sulphonating agent/PCBs was equal to 3.2:1. The reaction was conducted at room temperature (23° C.), under stirring for total 10 minutes.

Oxidation

The sulpho-derivatives obtained from the preceding reaction were taken up with 100 ml of $H_2O$ and introduced into a 250 ml four-neck flask, equipped with condenser, pH-meter, dropping funnel, thermometer and magnetic stirrer, and immersed in an oil bath at 95° C. The pH was brought to 3.4 by addition of NaOH. 132 ppm of Fe(II) ions and 132 ppm of Cu(II) ions were then added, in the form of heptahydrated sulphate and pentahydrated sulphate respectively. A gradual addition (at a rate of 0.4 ml/min.) of a hydrogen peroxide aqueous solution at 46% by volume, in an amount equal to 2.95 stoichiometric equivalents, was then effected. The reaction lasted 45 minutes.

Both on the starting PCBs and on the products obtained at the end of each process step, the COD value, the total concentration of PCBs and of $Cl^-$ ions were determined according to the methods described above. The results are reported in Table I, where also the maximum obtainable $Cl^-$ ion concentration is indicated. The mineralization percentage, expressed as ratio of the actually obtained $Cl_-$ ion concentration to the maximum obtainable theoretical concentration was substantially equal to 100%.

On the mixture obtained at the end of the oxidation reaction, a $BOD_5$ equal to 80 mg/l was measured according to the above-indicated method.

EXAMPLE 2

Sulphonation of PCBs dissolved in mineral oil 100 ml of a mineral oil containing 2137 ppm of PCBs were placed into a 100 ml three-neck flask, equipped with condenser, magnetic stirrer, dropping funnel and thermometer. 0.36 ml of oleum ($H_2SO_4+SO_3$) were dropped into the flask immersed in an oil bath at 25° C. The reaction was immediate, accompanied by darkening of the mineral oil. The sulphonation products were extracted with $H_2O$ in a separating funnel, with a ratio $H_2O$/ reaction mixture equal to 0.3:1.

Oxidation

To the sulpho-derivative solution so obtained, a solution at 10% by weight of NaOH was gradually added, in order to bring the pH to about 3.4. The solution was then introduced into a 50 ml four-neck flask, equipped with condenser, pH-meter, thermometer, dropping funnel and magnetic stirrer, immersed in an oil bath at 95° C. 140 ppm of Fe(II) ions and 140 ppm of Cu(II) ions, in the form of heptahydrated sulphate and of pentahydrated sulphate respectively, were then added. A gradual addition (at a rate of 0.6 ml/min) of a hydrogen peroxide aqueous solution at 46%, in amounts equal to 4.0 stoichiometric equivalents, was then effected. The reaction was slightly exothermic and lasted 55 minutes.

The results of the analyses carried out on the starting mineral oil and on the products obtained at the end of each process step are reported in Table I.

TABLE I

| EX. | | COD (mg/l) | [PCBs] (ppm) | [$Cl^-$] (ppm) |
|---|---|---|---|---|
| 1 | starting | 22,000 | 16,400 | (8,395)(*) |
| | after step (a) | 14,197 | 0 | 0 |
| | after step (b) | 200 | 0 | 8,400 |
| 2 | starting | 3,100 | 2,137 | (1,100)(*) |
| | after step (a) | 2,900 | <0,2 | 0 |
| | after step (b) | 100 | <0,2 | 1,094 |

(*)maximum obtainable concentration of $Cl^-$ ions.

EXAMPLE 3

Nitration of pure PCBs

Into a 40 ml three-neck flask, equipped with condenser, dropping funnel, thermometer and magnetic stirrer, 114.5 μl of pure PCBs (commercial product: Aroclor® 1242), dissolved in 20 ml of $H_2SO_4$ at 96% by weight (PCBs concentration: 7478 ppm), were introduced. The reaction mixture was heated in an oil bath at 130° C. To the reaction mixture 2.6 molar equivalents of fuming $HNO_3$ (at 90% by weight), at a rate of 0.22 molar equivalent/min, were gradually added. The nitration reaction was conducted, under stirring, for total 12 minutes. The reaction mixture was then poured into an equal volume of water and ice. A pale orange pulverulent precipitate was obtained, which was separated from the aqueous phase by decantation.

Oxidation

The nitro-derivatives obtained from the preceding reaction were taken up with 100 ml of $H_2O$ and introduced into a 250 ml four-neck flask, equipped with condenser, pH-meter, dropping funnel, thermometer and magnetic stirrer, and immersed in an oil bath at 95° C. The pH was brought to 3.4 by addition of NaOH. 132 ppm of Fe(II) ions and 132 ppm of Cu(II) ions, in the form respectively of heptahydrated sulphate and pentahydrated sulphate, were then added. A gradual addition (at a rate of 0.4 ml/min) of a hydrogen peroxide aqueous solution at 46% by volume, in an amount equal to 4 stoichiometric equivalents, was then effected. The reaction lasted 25 minutes.

The results of the analyses conducted on the starting PCBs and on the products obtained at the end of each process step are indicated in Table II.

On the mixture obtained at the end of the oxidation reaction, a $BOD_5$ value equal to 50 mg/l was measured according to the above-indicated method.

EXAMPLE 4

Nitration of PCBs dissolved in mineral oil

Into a 100 ml, three-neck flask equipped with condenser, magnetic stirrer, dropping funnel and thermometer, 50 ml of a mineral oil containing 2137 ppm of PCBs were introduced. Into the flask, immersed in an oil bath at 130° C., a mixture consisting of 5 ml of fuming HNO3 (at 90% by weight) and of 2 ml of $H_2SO_4$ at 96% by weight was dropped at a flowrate equal to 0.5 ml/min.

The reaction was conducted at 130° C., under stirring, for total 15 minutes. The nitration products were extracted with $H_2O$ in a separatory funnel, with a $H_2O$/-reaction mixture molar ratio of 1:1.

Oxidation

To the resulting nitro-derivative solution, a 10% by weight NaOH solution was gradually added, in order to bring the pH to about 3.4. The solution was then introduced into a 50 ml four-neck flask, equipped with condenser, pH-meter, thermometer, dropping funnel and magnetic stirrer, immersed in an oil bath at 95° C. 140 ppm of Fe(II) ions and 140 ppm of Cu(II) ions, in the form respectively of heptahydrated sulphate and pentahydrated sulphate, were then added. Thereafter (at a rate of 0.6 ml/min) a $H_2O_2$ aqueous solution at 46% by volume was gradually added in an amount equal to 5.0 stoichiometric equivalents. The reaction, slightly exothermic, lasted 55 minutes. The results of the analyses conducted on the starting mineral oil and on the products obtained at the end of each process step are reported in Table II. On the mixture obtained at the end of the oxidation reaction, the concentration of nitrates and nitrites was determined by means of liquid-liquid ionic chromatography at 30° C. (column: Microsphere® 100-$NH_2$; detector: UV spectrometer at 205 nm). 57 ppm of nitrates and 1 ppm of nitrites were found.

TABLE II

| EX. | | COD (mg/l) | [PCBs] (ppm) | [$Cl^-$] (ppm) |
|---|---|---|---|---|
| 3 | starting | 11,000 | 7,478 | (3,828)(*) |
| | after step (a) | 10,000 | 10 | 0 |
| | after step (b) | 100 | 10 | 3,750 |
| 4 | starting | 3,100 | 2,200 | (1,213)(*) |
| | after step (a) | 2,910 | 14 | 0 |
| | after step (b) | 132 | 14 | 1,200 |

(*)maximum obtainable concentration of $Cl^-$ ions.

EXAMPLE 5

Sulphonation of pure DDT

Into a 100 ml two-neck flask, equipped with dropping funnel, thermometer and magnetic stirrer, 0.34 g of DDT (1,1,1-trichloro-2,2-bis(p-chlorophenil)ethane) were introduced. Into said flask, 0.318 ml of oleum were then dropped with a flowrate of about 0.13 ml/min. The molar ratio sulphonating agent/DDT was 4:1. The reaction was carried out at room temperature (23° C. ), under stirring, for total 10 minutes.

Oxidation

The sulpho-derivatives obtained from the preceding reaction were taken up with 100 ml of $H_2O$ and introduced into a 250 ml four-neck flask, equipped with condenser, pH-meter, dropping funnel, thermometer and magnetic stirrer, and immersed in an oil bath at 95° C. The pH was brought to 3.2 by addition of NaOH. 200 ppm of Fe(II) ions and 200 ppm of Cu(II) ions were then added, in the form of heptahydrated sulphate and pentahydrated sulphate respectively. A gradual addition (at a rate of 0.35 ml/min.) of a hydrogen peroxide aqueous solution at 56% by volume, in an amount equal to 3 stoichiometric equivalents, was then effected. The reaction lasted 30 minutes.

The results of the analysis on the starting DDT and on the products obtained at the end of each step of the process are reported in Table III, where also the maximum obtainable $Cl^-$ ion concentration is indicated. The mineralization percentage, expressed as ratio of the actually obtained $Cl^-$ ion concentration to the maximum obtainable theoretical concentration, was substantially equal to 100%.

TABLE III

| EX. | | COD (mg/l) | [DDT] (ppm) | [$Cl^-$] (ppm) |
|---|---|---|---|---|
| 5 | starting | 4987 | 3400 | (7000)* |
| | after step (a) | 4050 | 1000 | 262 |
| | after step (b) | 700 | 0 | 1670 |

*maximum obtainable concentration of $Cl^-$ ions.

EXAMPLE 6

Sulphonation of pure trichloroethylene

Into a 100 ml two-neck flask, equipped with dropping funnel, thermometer and magnetic stirrer, 0.5 g (0.34 ml) of trichloroethylene ($C_2HCl_3$) were introduced. Into said flask, 1.88 ml of oleum were then dropped with a flowrate of about 0.13 ml/min. The molar ratio sulphonating agent/$C_2HCl_3$ was 6:1. The reaction was carried out at room temperature (23° C.), under stirring, for total 10 minutes.

Oxidation

The sulpho-derivatives obtained from the preceding reaction were taken up with 100 ml of $H_2O$ and introduced into a 250 ml four-neck flask, equipped with condenser, pH-meter, dropping funnel, thermometer and magnetic stirrer, and immersed in an oil bath at 95° C. The pH was brought to 3.25 by addition of NaOH. 200 ppm of Fe(II) ions and 200 ppm of Cu(II) ions were then added, in the form of heptahydrated sulphate and pentahydrated sulphate respectively. A gradual addition (at a rate of 0.35 ml/min.) of a hydrogen peroxide aqueous solution at 56% by volume, in an amount equal to 4 stoichiometric equivalents, was then effected. The reaction lasted 50 minutes.

The results of the analysis on the starting $C_2HCl_3$ and on the products obtained at the end of each step of the process are reported in Table IV, where also the maximum obtainable $Cl^-$ ion concentration is indicated. The mineralization percentage, expressed as ratio of the actually obtained $Cl^-$ ion concentration to the maximum obtainable theoretical concentration, was substantially equal to 100%.

TABLE IV

| EX. | | COD (mg/l) | [$C_2HCl_3$] (ppm) | [$Cl^-$] (ppm) |
|---|---|---|---|---|
| 6 | starting | 2740 | 5000 | (4048)* |
| | after step (a) | 1800 | 0 | 1447 |
| | after step (b) | — | 0 | 4000 |

*maximum obtainable concentration of $Cl^-$ ions.

EXAMPLE 7

Sulphonation of pure tetrachloroethane

Into a 100 ml two-neck flask, equipped with dropping funnel, thermometer and magnetic stirrer, 0.5 g (0.315 ml) of tetrachloroethane ($C_2H_2Cl_4$) were introduced. Into said flask, 1.47 ml of oleum were then dropped with a flowrate of about 0.13 ml/min. The molar ratio sulphonating agent/$C_2H_2Cl_4$ was 6:1. The reaction was carried out at room temperature (23° C.), under stirring, for total 10 minutes.

Oxidation

The sulpho-derivatives obtained from the preceding reaction were taken up with 100 ml of $H_2O$ and introduced into a 250 ml four-neck flask, equipped with condenser, pH-meter, dropping funnel, thermometer and magnetic stirrer, and immersed in an oil bath at 95° C. The pH was brought to 3.33 by addition of NaOH. 200 ppm of Fe(II) ions and 200 ppm of Cu(II) ions were then added, in the form of heptahydrated sulphate and pentahydrated sulphate respectively. A gradual addition (at a rate of 0.35 ml/min.) of a hydrogen peroxide aqueous solution at 56% by volume, in an amount equal to 4 stoichiometric equivalents, was then effected. The reaction lasted 40 minutes.

The results of the analysis on the starting $C_2H_2Cl_4$ and on the products obtained at the end of each step of the process are reported in Table V, where also the maximum obtainable $Cl^-$ ion concentration is indicated. The mineralization percentage, expressed as ratio of the actually obtained $Cl^-$ ion concentration to the maximum obtainable theoretical concentration, was substantially equal to 100%.

TABLE V

| EX. | | COD (mg/l) | [$C_2H_2Cl_4$] (ppm) | [$Cl^-$] (ppm) |
|---|---|---|---|---|
| 7 | starting | 2400 | 5000 | (4225)* |
| | after step (a) | 2000 | 390 | 1402 |
| | after step (b) | 350 | 390 | 3850 |

*maximum obtainable concentration of $Cl^-$ ions.

EXAMPLES 8–9

Sulphonation of pure ortho- or metha-dichlorobenzene

Into a 100 ml two-neck flask, equipped with dropping funnel, thermometer and magnetic stirrer, 1.0 g (0.766 ml) of ortho-dichlorobenzene (ODB) (Example 4) or of methadichlorobenzene (MDB) (Example 5) were introduced. Into said flask, 1.7 ml (for ODB) or 2.93 ml (for MDB) of oleum were then dropped with a flowrate of about 0.13 ml/min. The molar ratio sulphonating agent/ODB was 3:1, while the molar ratio sulphonating agent/MDB was 5:1. The reaction was carried out at room temperature (23° C.), under stirring, for total 10 minutes.

Oxidation

The sulpho-derivatives obtained from the preceding reaction were taken up with 100 ml of $H_2O$ and introduced into a 250 ml four-neck flask, equipped with condenser, pH-meter, dropping funnel, thermometer and magnetic stirrer, and immersed in an oil bath at 95° C. The pH was brought to 3.4 (for ODB) or 3.28 (for MDB) by addition of NaOH. 200 ppm of Fe(II) ions and 200 ppm of Cu(II) ions were then added, in the form of heptahydrated sulphate and pentahydrated sulphate respectively. A gradual addition (at a rate of 0.35 ml/min.) of a hydrogen peroxide aqueous solution at 56% by volume, in an amount equal to 3 stoichiometric equivalents, was then effected. The reaction lasted 60 minutes.

The results of the analysis on the starting ODB or MDB and on the products obtained at the end of each step of the process are reported in Tables VI (ODB) and VII (MDB), where also the maximum obtainable $Cl^-$ ion concentration is indicated. The mineralization percentage, expressed as ratio of the actually obtained $Cl^-$ion concentration to the maximum obtainable theoretical concentration, was substantially equal to 100%.

TABLE VI

| EX. | | COD (mg/l) | [ODB] (ppm) | [$Cl^-$] (ppm) |
|---|---|---|---|---|
| 8 | starting | 15238 | 10000 | (4820)* |
| | after step (a) | 14900 | 0 | 0 |

TABLE VI-continued

| EX. | | COD (mg/l) | [ODB] (ppm) | [$Cl^-$] (ppm) |
|---|---|---|---|---|
| | after step (b) | 50 | 0 | 4800 |

*maximum obtainable concentration of $Cl^-$ ions.

TABLE VII

| EX. | | COD (mg/l) | [MDB] (ppm) | [$Cl^-$] (ppm) |
|---|---|---|---|---|
| 9 | starting | 15238 | 10000 | (4820)* |
| | after step (a) | 14900 | 0 | 0 |
| | after step (b) | 50 | 0 | 4800 |

*maximum obtainable concentration of $Cl^-$ ions.

We claim:

1. A process for the disposal of chlorinated organic products in an organic medium or in a pure state, which comprises:

(a) treating the chlorinated organic products with a sulfonating or nitrating agent;

(b) separating the sulfonation or nitration products from the reaction mixture;

(c) adjusting the pH to a value from 1 to 7 and oxidizing the sulfonation or nitration products from step (b) with an aqueous solution of $H_2O_2$, in the presence of Fe(II) ions.

2. The process of claim 1, wherein the chlorinated organic products have an aromatic, alkyl-aromatic, olefinic, aliphatic or cycloaliphatic structure.

3. The process of claim 1 wherein the sulphonating agent is $H_2SO_4$ or oleum.

4. The process of claim 3, wherein $H_2SO_4$ is utilized in the form of a concentrated aqueous solution, at concentrations ranging from 70 to 99% by weight.

5. The process of claim 3, wherein the molar ratio of sulphonating agent to chlorinated organic product ranges from 0.5:1 to 10:1.

6. The process of claim 1 wherein the nitrating agent is $HNO_3$, in admixture with a strong mineral acid selected from $H_2SO_4$, $H_3PO_4$, or HCl.

7. The process of claim 6, wherein $HNO_3$ is utilized in the form of a concentrated aqueous solution, at concentrations ranging from 50 to 99% by weight.

8. The process of claim 6, wherein the molar ratio of strong mineral acid to $HNO_3$ ranges from 0.5 to 5.0.

9. The process of claim 6, wherein the strong mineral acid is $H_2SO_4$ utilized in the form of a concentrated aqueous solution, at concentrations ranging from 70 to 99% by weight.

10. The process of any of claim 6, wherein the molar ratio of nitrating agent to chlorinated organic product ranges from 1:1 to 500:1.

11. The process of claim 1, wherein, prior to step (c), a further step (9') is carried out which comprises adjusting the pH of the sulfonation or nitration products from step (b) to a value from 5–9, and treating them with an aminating agent.

12. The process of claim 11, wherein the aminating agent is a concentrated aqueous solution of $NH_3$.

13. The process of claim 1, wherein in step (c) $H_2O_2$ is utilized in amounts ranging from 1 to 40 stoichiometric equivalents.

14. The process of claim 13, wherein $H_2O_2$ is utilized in amounts ranging from 1 to 10 stoichiometric equivalents.

15. The process of claim 1 wherein the oxidizing of step (c) is carried out in association with ions of one or more transition metals selected from Cu(II), Ti(IV), Mn(II), Co(II), Ni(II), W(IV), and Mo(IV).

16. The process of claim 15, wherein in step (c) the Fe(II) ions are added in amounts ranging from 50 to 500 ppm, while the ions of one or more transition metals selected from Cu(II), Ti(IV), Mn(IV), Co(II), Ni(II), W(IV), and Mo(IV) are added in amounts ranging from 0 to 400 ppm.

17. The process of claim 15, wherein in step (c) the Fe(II) ions are utilized in association with ions of one or more transition metals selected from Cu(II), Ti(IV), Mn(IV), Co(II), Ni(II), W(IV), and Mo(IV), each in concentrations ranging from 50 to 400 ppm.

18. The process of claim 1, wherein in step (c) the Fe(II) ions are utilized in association with Cu (II) ions.

19. The process of claim 1, wherein the oxidation reaction of step (c) is conducted at a temperature ranging from 20° to 100° C.

20. The process of claim 1, wherein the oxidation reaction of step (c) is conducted at a pH level from 3 to 4.

* * * * *

UNITED STATES PATENT AND TRADEMARK OFFICE

CERTIFICATE OF CORRECTION

PATENT NO. : 5,430,231

DATED : July 4, 1995

INVENTOR(S): Ivan Wlassics, et al.

It is certified that error appears in the above-identified patent and that said Letters Patent is hereby corrected as shown below:

| Column | Line | Delete | Insert |
|---|---|---|---|
| 10 | 55 | "(9')" | -- (a') -- |
| 11 | 6 | "Mn (IV)" | -- Mn (II) -- |
| 12 | 1 | "Mn (IV)" | -- Mn (II) -- |

Signed and Sealed this

Fifth Day of December, 1995

*Attest:*

*Attesting Officer*

Bruce Lehman

BRUCE LEHMAN

*Commissioner of Patents and Trademarks*